United States Patent [19]

Wolf

[11] Patent Number: 4,758,033

[45] Date of Patent: Jul. 19, 1988

[54] WINDOW LOCK

[76] Inventor: Conrad Wolf, 8-08 College Pl., College Point, N.Y. 11356

[21] Appl. No.: 937,389

[22] Filed: Dec. 3, 1986

[51] Int. Cl.[4] ..... E05C 17/20

[52] U.S. Cl. ..... 292/305

[58] Field of Search ..... 292/305, 306, 262, 276, 292/277, 278, 275

[56] References Cited

U.S. PATENT DOCUMENTS

| | | | |
|---|---|---|---|
| 386,938 | 7/1888 | Snyder et al. | 292/305 |
| 392,000 | 10/1888 | Anderson et al. | 292/305 |
| 1,552,351 | 9/1925 | Setterstrom et al. | 292/305 X |
| 1,851,701 | 3/1932 | Goll | 292/305 |
| 1,874,098 | 8/1932 | Haff | 292/305 |
| 2,714,033 | 7/1955 | Lewgowd | 292/305 |

*Primary Examiner*—Richard E. Moore

*Attorney, Agent, or Firm*—Michael I. Kroll

[57] ABSTRACT

A window lock for a window that has an outer sash and an inner sash in a wall is provided and consists of an upper mounting bracket attached to interior surface on top rail of the outer sash of the window and a lower mounting bracket positioned onto bottom meeting rail of the outer sash of the window. The upper mounting bracket has a portion extending downwardly from the top rail to be received and adjustably secured within a portion of the lower mounting bracket extending outwardly thus allowing the inner and outer sashes of the window limited travel for the top meeting rail of the inner sash will contact the outwardly extending portion of lower mounting bracket.

2 Claims, 1 Drawing Sheet

WINDOW LOCK

BACKGROUND OF THE INVENTION

1. Field of the Invention

The instant invention relates generally to locks and more specifically it relates to a window lock.

2. Description of the Prior Art

Numerous locks have been provided in prior art that are adapted to fasten objects, specifically for securing doors, drawers or the like, as to prevent their being opened except by special keys or combinations. While these units may be suitable for the particular purpose to which they address, they would not be as suitable for the purposes of the present invention as heretofore described.

SUMMARY OF THE INVENTION

A primary object of the present invention is to provide a window lock that will overcome the shortcomings of the prior art devices.

Another object is to provide a window lock that is safe to use since once installed within a window a person will not fall out when said invention is properly adjusted.

An additional object is to provide a window lock that can be used for security and can be quickly opened in case of fire.

A further object is to provide a window lock that is simple and easy to use.

A still further object is to provide a window lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
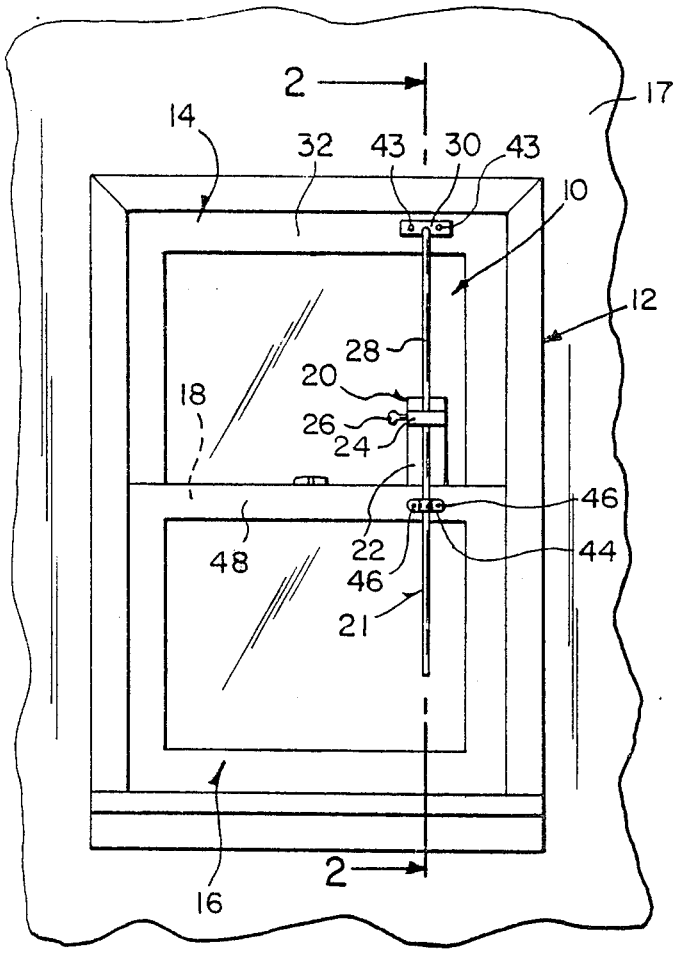
FIG. 1 is a front view of the invention mounted to a window in a building.
Figure 2:
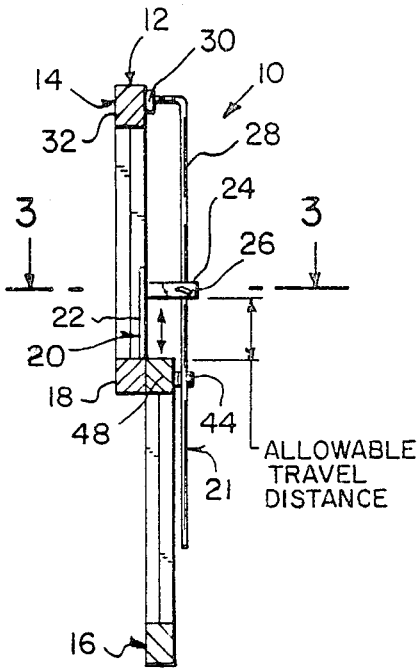
FIG. 2 is a cross sectional view taken along line 2—2 in FIG. 1.
Figure 3:
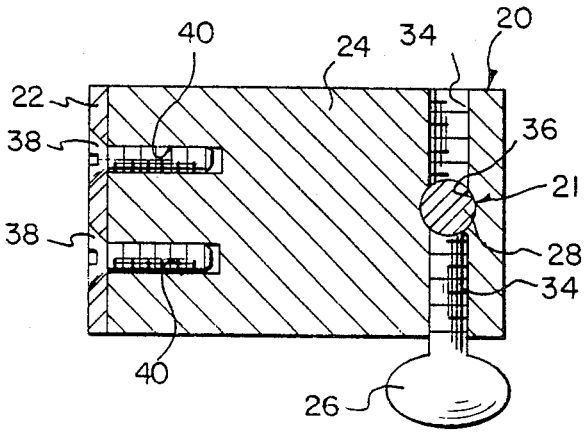
FIG. 3 is an enlarged cross sectional view taken along line 3—3 in FIG. 2.
Figure 4:
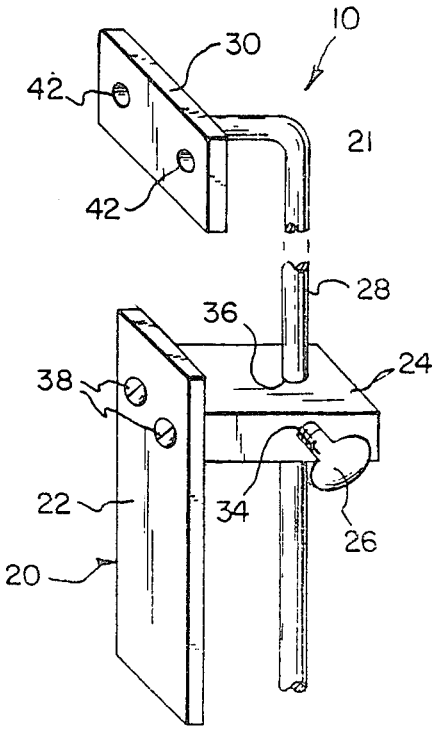
FIG. 4 is a perspective view of the invention with parts broken away.

Turning now descriptively to the drawings, in which similar reference characters denote similar elements throughout the several views, FIGS. 1 to 4 illustrates a window lock 10 for a window 12 that has an outer sash 14 and in inner sach 16 in a wall 17. The lock 10 consists of an upper mounting bracket 21 and a lower mounting bracket 20. The upper mounting bracket 20 is attached to interior surface on top rail 32 of the outer sash 14 of the window 12. The upper mounting bracket 21 has a portion 28 extending downwardly from the top rail 32. The lower mounting bracket 20 is positioned onto bottom meeting rail 18 of the outer sash 14 of the window 12. The lower mounting bracket 20 has a portion 24 extending outwardly to receive and adjustably secure the portion 28 extending downwardly from the upper mounting bracket 21, thus allowing the inner and outer sashs 16 and 14 of the window 12 limited travel, for the top meeting rail 48 of the inner sash 16 will contact the outwardly extending portion 24 of the lower mounting bracket 20.

The upper mounting bracket 21 further contains a plate 30 attached to the interior surface on the top rail 32 of the outer sash 14 of the window 12. The downwardly extending portion 28 is an inverted L-shaped elongated rod attached to the plate 30.

The lower mounting bracket 20 is in a generally inverted L-shaped configuration further comprising a vertical plate 22 positioned onto the bottom meeting rail 18 of the outer sash 14 of the window 12. The outwardly extending portion 24 is a horizontal plate attached at one end, via threaded holes 40 and bolts 38, to the vertical plate 22. The horizontal plate 24 has a vertical hole 36 therethrough to receive the rod 28 and a horizontal threaded hole 34 intersecting the vertical hole 36. A wing bolt 26 is receivable from either side of the horizontal threaded hole 34 in the horizontal plate 24 to secure the rod 28 therein and whereby when the wing bolt 26 is loosened the inner and outer sashes 16 and 14 can be opened freely.

The plate 30 of the upper mounting bracket 21 has a pair of spaced apart mounting holes 42 therethrough. A pair of mounting screws 43 are provided in which each extends through one of the mounting holes 42 in the plate 30 and into the interior surface on the top rail 32 of the outer sash 14.

A guide bracket 44 is attached with screws 46 to interior surface of the top meeting rail 48 on the inner sash 16 of the window 12 to receive the rod 28 so that when either of the inner and outer sashs 16 and 14 are moved the guide bracket 44 will slide on the rod 28 thus stabilizing the rod.

While certain novel features of this invention haven been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lock structure comprising:

(a) a window having an outer sash with a top rail having an interior surface and a bottom meeting rail, said window having an inner sash with a top meeting rail;

(b) an upper mounting bracket having a plate attached to said interior surface of said top rail of said outer sash of said window, said upper mounting bracket having an inverted L-shaped elongated rod attached to and extending downwardly from said plate;

(c) a lower mounting bracket having a vertical plate positioned onto said bottom meeting rail of said outer sash of said window and a horizontal plate with a one end attached to said vertical plate, said horizontal plate having a vertical hole therethrough to receive said inverted L-shaped elongated rod and a horizontal threaded hole intersecting said vertical hole and a wing bolt disposed in said horizontal threaded hole in said horizontal plate to adjustably secured said inverted L-shaped rod therein so that limited travel of said inner and outer sashes of said window is allowed; and (d) a guide bracket attached to said interior surfaces of said top meeting rail of said inner sash of said window to receive said inverted L-shaped elongated rod so that when either of said inner and outer sashes are moved said guide bracket will guide said inverted L-shaped elongated rod and stabilized inverted L-shaped elongated rod.

2. A window lock as recited in claim 1, wherein said plate of said upper mounting bracket contains a pair of spaced apart mounting holes therethrough so that a mounting screw may extend through each of said mounting holes contained in said plate and into the interior surface on the top rail of the outer sash.

* * * * *